US010900648B2

(12) United States Patent
Zeng et al.

(10) Patent No.: US 10,900,648 B2
(45) Date of Patent: Jan. 26, 2021

(54) DOWNLIGHT APPARATUS

(71) Applicant: XIAMEN ECO LIGHTING CO. LTD., Xiamen (CN)

(72) Inventors: Maojin Zeng, Xiamen (CN); Xiaoliang Wen, Xiamen (CN); Liu Yi, Xiamen (CN); Xiaojuan Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/049,814

(22) Filed: Jul. 31, 2018

(65) Prior Publication Data

US 2019/0063736 A1 Feb. 28, 2019

(30) Foreign Application Priority Data

Aug. 25, 2017 (CN) ..... 2017 2 1073727 U

(51) Int. Cl.

| | |
|---|---|
| ***F21V 21/30*** | (2006.01) |
| ***F21S 8/02*** | (2006.01) |
| ***F21V 21/04*** | (2006.01) |
| ***F21V 29/70*** | (2015.01) |
| ***F21V 14/02*** | (2006.01) |
| ***F21V 14/06*** | (2006.01) |
| *F21Y 115/10* | (2016.01) |

(52) U.S. Cl.

CPC ..... *F21V 21/30* (2013.01); *F21S 8/026* (2013.01); *F21V 14/02* (2013.01); *F21V 14/06* (2013.01); *F21V 21/04* (2013.01); *F21V 29/70* (2015.01); *F21Y 2115/10* (2016.08)

(58) Field of Classification Search

CPC ..... F21V 21/30; F21V 29/70; F21V 21/04; F21S 8/026

See application file for complete search history.

(56) References Cited

U.S. PATENT DOCUMENTS

| | | | | |
|---|---|---|---|---|
| 9,182,093 | B2 * | 11/2015 | Santiago | F21S 8/046 |
| 10,247,390 | B1 * | 4/2019 | Kopitzke, IV | F21V 17/02 |
| 2017/0234517 | A1 * | 8/2017 | Highbridge | F21V 21/26 362/427 |

* cited by examiner

*Primary Examiner* — Joseph L Williams
(74) *Attorney, Agent, or Firm* — Chun-Ming Shih; Lanway IPR Services

(57) ABSTRACT

A downlight apparatus includes a light source, a rotatable support, a confining structure and a fixing unit. The light source includes one or more LED modules. The rotatable support having a rotatable surface. The rotatable surface having a partial-sphere external surface. The light source is fixed to the rotatable support. When the rotatable support is rotated, a light emitting direction of the light source is changed correspondingly. The confining structure holds the rotatable support for rotation. The confining structure has an inner surface defining a rotating space. The rotatable support is rotated within the rotating space. The fixing unit is connected to the confining structure.

19 Claims, 9 Drawing Sheets

DOWNLIGHT APPARATUS

FIELD OF INVENTION

The present invention is related to a downlight apparatus and more particularly related to a downlight with manual control.

BACKGROUND

There are various light devices in the world. LED technologies help make light devices even more efficient. Therefore, there are more and more LED light devices in the world.

In the past, people use light devices to get light. Expectation was not much and most are easily satisfied. With civilization advancement for the past hundred years, people now are not satisfied with a device that provides light. People want more control, more functions, more convenience to suit different needs in different places.

For example, people expect using spot lights only in commercial places like department stores. Now, many people have their own collection like paintings and would like to decorate their house with proper lights in different corners.

Even eating dinner, people now expect a light environment more like great restaurant. Traditional way of light designs is not sufficient for facing today's design needs.

Therefore, it is beneficial if traditional designs may be modified for bringing more advantages. Any such innovation, particularly in the field of downlight devices, which are usually installed in a cavity of a ceiling, would bring great technical effect for people's life. Other factors, like manufacturing cost, are also important if they are well considered.

SUMMARY OF INVENTION

According to an embodiment of the present invention, a downlight apparatus includes a light source, a rotatable support, a confining structure, and a fixing unit.

The light source may include one or more LED module. The LED modules may be mounted on a light source plate with wires and a heat sink. The light source plate may be attached to a surface of the rotatable support. The LED modules are provided with a proper driver current. In some embodiments, the LED modules may have different types, e.g. with different color temperatures or colors, and the LED modules may be controlled to generate different mixed light effect.

The rotatable support has a rotatable surface. The rotatable surface has a partial-sphere external surface. The partial-sphere external surface refers to a surface substantially similar to a portion or all of a three-dimension surface of a sphere. Please be noted that the partial-sphere external surface does not need to be a perfect sphere surface, once the surface provides a rotatable joint effect in three-dimension space.

The light source is fixed to the rotatable support. Therefore, when the rotatable support is rotated, a light emitting direction of the light source is changed correspondingly. Specifically, the light surface is fixed to the rotatable support, and the rotatable support is rotated with respect to the confining structure. If the confining structure is fixed to a ceiling, the light emitting direction of the light source is changed when the rotatable support is rotated with respect to the confining structure.

The confining structure is provided for holding the rotatable support so that the rotatable support may be rotated with respect to the confining structure. The confining structure has an inner surface defining a rotating space. The rotatable support is rotated within the rotating space. The rotating space refers to a three-dimension area where the rotatable support is rotated therein.

The fixing unit is connected to the confining structure for fixing the downlight apparatus in a cavity. For example, the fixing unit may include two elastic arms that may be deformed to fit in the cavity and extended back to keep the downlight apparatus in the cavity. The fixing unit may be directly or indirectly connected to the confining structure. For example, the fixing unit may be directly fixed to a socket of the confining structure or an intermediate component like a surface ring that is connected to the confining structure.

In some embodiments, the confining structure has a top cover and a bottom cover. When the top cover and the bottom cover are assembled together, the top cover and the bottom cover together form a containing space in which the partial-sphere surface of the rotatable support may be rotated therein. In addition, the containing space keeps the rotatable support staying in the containing space, instead of leaving unless the top cover is detached from the bottom cover.

The top cover has a lateral blocking structure. The top cover also has a first top opening and a first bottom opening. A diameter of the first top opening is smaller than a diameter of the partial sphere surface. A diameter of the first bottom opening is larger than the first top opening. As mentioned above, such configuration keeps the rotatable support to stay in the containing space defined by the top cover and the bottom cover.

In some embodiments, the lateral blocking structure is mainly a surrounding wall for holding the rotatable support.

In some other embodiments, the lateral blocking structure may include multiple curve bars for holding the rotatable support. In other words, the "surrounding wall" may have holes or even may be provided with several equivalent curve bars once the curve bars define the containing space to keep the rotatable support within for rotating.

In some embodiments, the top cover may be a ring shape body with a smaller top opening than its bottom opening. The ring shape body may also has a corresponding inner surface for the partial-sphere surface of the rotatable support.

In some embodiments, the top cover may have one or more elastic extenders for pressing a surface of the rotatable support. The elastic extenders apply a force on a surface of the rotatable support so that the rotatable support would not make undesired movement when users do not give force thereon.

To increase the effect, a friction enhancer may be mounted on the elastic extender for increasing friction between the confining structure and the rotation support so that the rotatable support is not moved without an external force.

For example, the friction enhance may be a rubber component, or may be a comb structure at end of the elastic extender. The elastic extender may be a separate component from the confining structure or may be a portion that is bent and leaning toward the rotatable support from a main body of the confining structure.

In some embodiments, there may be multiple segment structures for securing the rotation support staying in corresponding rotation angles with a force. For example, protruding grooves or concave groove with corresponding elastic may form such segment structures so that when the rotation support rotates to a specific angle, two corresponding components respectively on the rotation support and the confining structure meet together and creates a certain resistance for preventing the rotation support to continue rotating unless a force is larger than a predetermined threshold.

Such design makes the downlight apparatus more stable, though losing certain freedom of rotation. But, under some design needs, such configuration provides better satisfaction.

In some embodiments, the bottom cover is fixed to a surface ring. The surface ring is a ring with a main opening for light of the light source to output. The bottom side of such surface ring is positioned downwardly so that users may see the its bottom side when the downlight apparatus is fixed to a cavity of a ceiling. Such surface ring is wider and commonly seen in traditional downlight devices. The back side of the surface ring is facing to the ceiling.

The bottom cover and the surface ring may be made as a single piece, e.g. made from the same molding procedure. Please be noted that the bottom cover and the surface may also be two pieces to be assembled during manufacturing.

In some embodiments, there is a limiting device for restricting a rotation range of the rotatable support. Although partial-sphere external surface may provide all angle rotation in a three-dimension space, when the partial-sphere approaches a complete sphere, it is not necessary to do so. In real applications, considering wire limitation to an external power source, the main opening size of the surface ring the downlight apparatus and other factors, it would be better to keep the rotation within a certain range.

Such limiting device have various ways to implement. For example, in some embodiment, the limiting device may be a top ring above the rotation support. When the rotation support rotates over the rotation range, the top ring engages the confining structure for stopping the rotatable support for further rotation.

In such design, the top ring may have a containing space, which is a nice place for containing driver components of a driver for converting an external power source, like a 110V or 220V electricity to a driving current for the light source.

In some embodiments, there may be a lens for converting a light of the light source to a light beam. Such lens may be a single convex or concave lens, and may be made of a lot of micro-lens structures together forming a desired light beam.

Since such downlight apparatus is designed for meeting users' needs for adjusting light output. It would be even better if the lens may be adjusted by changing its distance to the light source, which may provide different focal length and different light beam characteristics for different needs, e.g. to focus on a near object or a far object.

A screwed sleeve may be used for changing a relative distance between the lens and the light source. Furthermore, multi-lens structure may be used for getting more output combinations.

In some embodiments, the top cover and the bottom cover are fixed with a reverse hook structure for increasing difficulty on detaching the top cover from the bottom cover. In such design, when manufacturers assemble the top cover to the bottom cover, the reverse hook structure ensures unless using certain tools, users may not easily detach the top cover from the bottom cover, causing undesired accident.

Other methods, like using screws or glues, may also be used for fixing the top cover to the bottom cover. In some designs, users may even want to replace the rotatable support for a different light source. In such case, it would be more convenient for designing a detachable structure like clips for easy assembly work.

In some embodiments, the bottom cover has a handle for users to hold the handle for rotating the rotatable support. This is particularly helpful when such downlight apparatus is designed for being rotated to change its output light angle.

In some embodiments, the confining structure may include a heat sink for dissipating heat of the light source, e.g. a fin, a heat conductive material housing.

In some embodiments, there may be further a controller for detecting a current rotation status to determine a corresponding light characteristic for the light source to emit light. For example, when the light output direction is set downwardly, the controller may a light strength, a color temperature, a color or other characteristic that is different when the light output direction is set with a tilt angle. Usually, people may have different needs for different light characteristics when they want to rotate the rotation support for getting a different light output angle.

In some embodiments, the confining structure may include an elastic deformable structure to enlarge an entrance size for receiving the rotatable support and holding the rotatable support by an elastic force of the deformable structure.

In other words, such elastic structure ensures the rotatable support to enter the containing and rotation space of the confining structure. The elastic force of the elastic structure ensures the rotatable support not easy to escape from the rotation space.

In some embodiments, there may be a motor for driving the rotatable support to rotate. For example, a wireless control circuit is disposed in the downlight apparatus. Users may use their mobile phone to adjust the rotation angle by trigger the motor to perform the rotation of the rotation support. In some cases, a controller without wireless connection may also be programmed to change the rotation of the rotation support, e.g. the downlight apparatus providing different light output angles in the morning and in the afternoon.

People who have windows may find such feature particularly helpful because the sunshine changes its direction along the day time. In the night, the downlight apparatus may change its output light characteristic, as mentioned above.

There are other embodiments and will be explained more in following sections.

DETAILED DESCRIPTION

Figure 1:
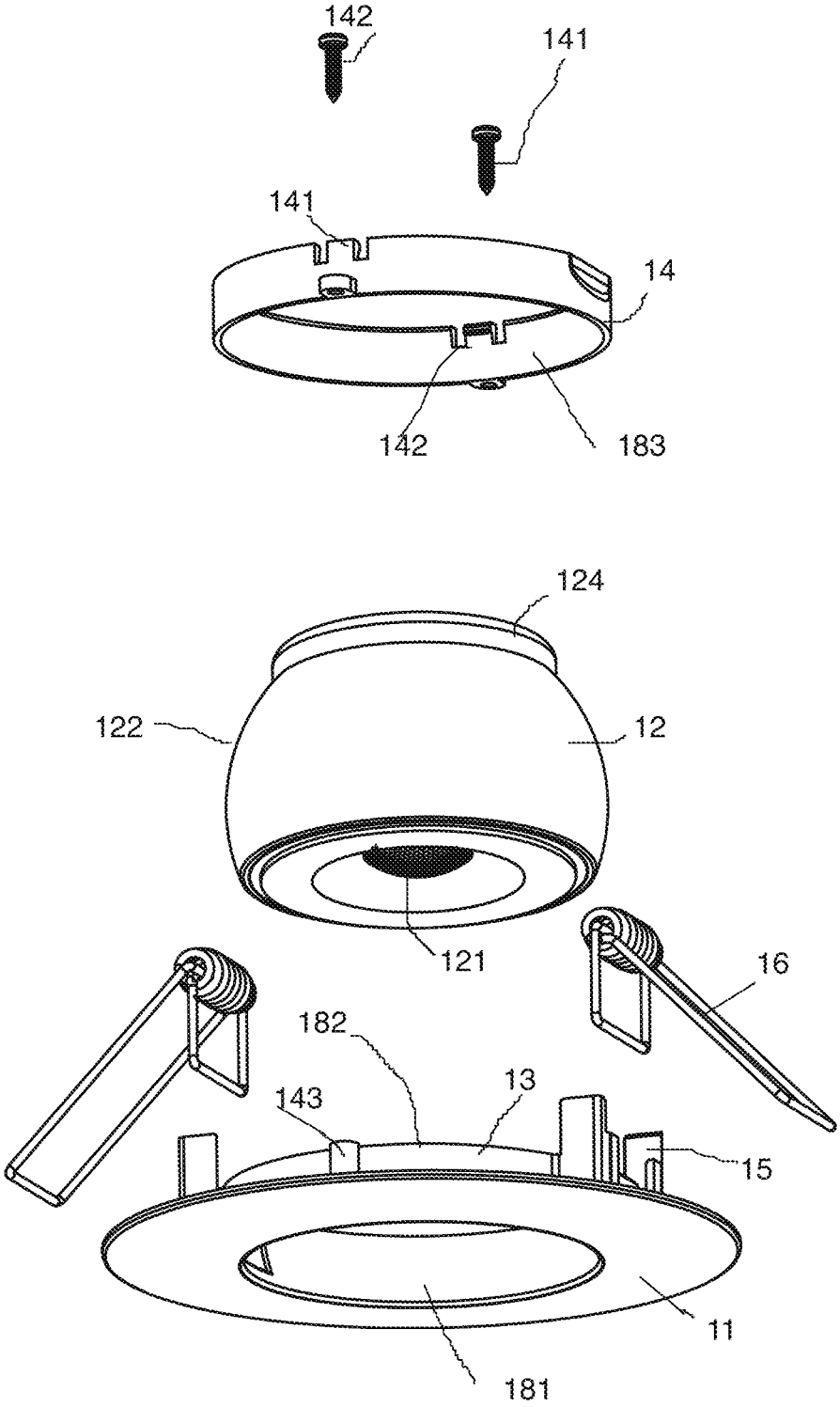
FIG. 1 is an exploded view of a diagram for a downlight apparatus embodiment.
Figure 2:
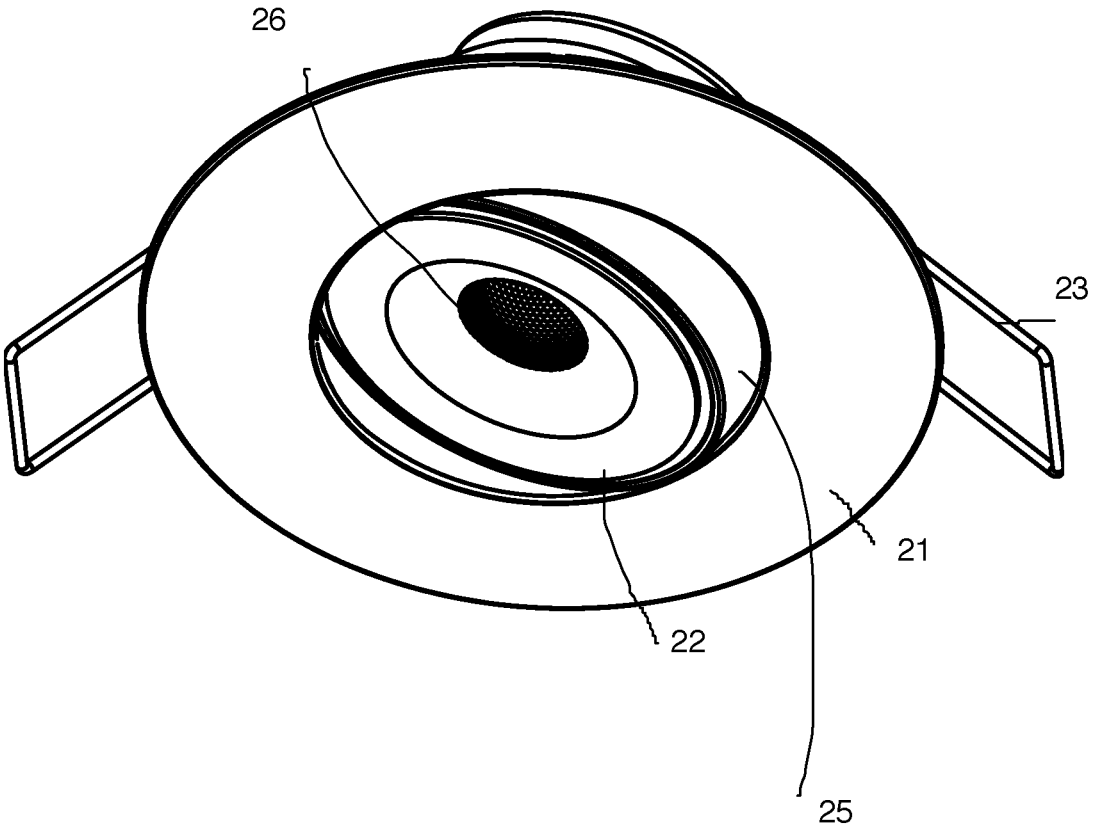
FIG. 2 is a perspective view of the embodiment of FIG. 1, showing its exemplary use.
Figure 3:
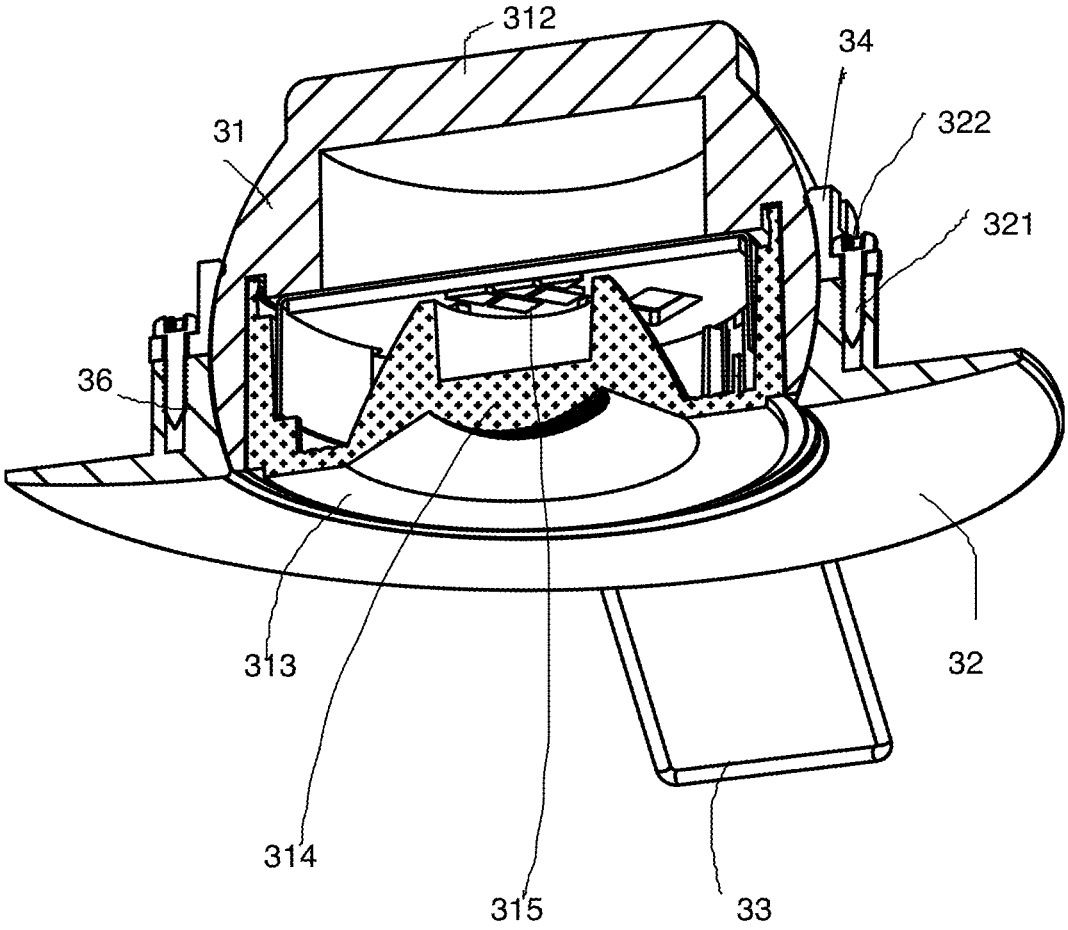
FIG. 3 is a sectional perspective view of the inner rotation structure of the embodiment of FIG. 1.
Figure 4:
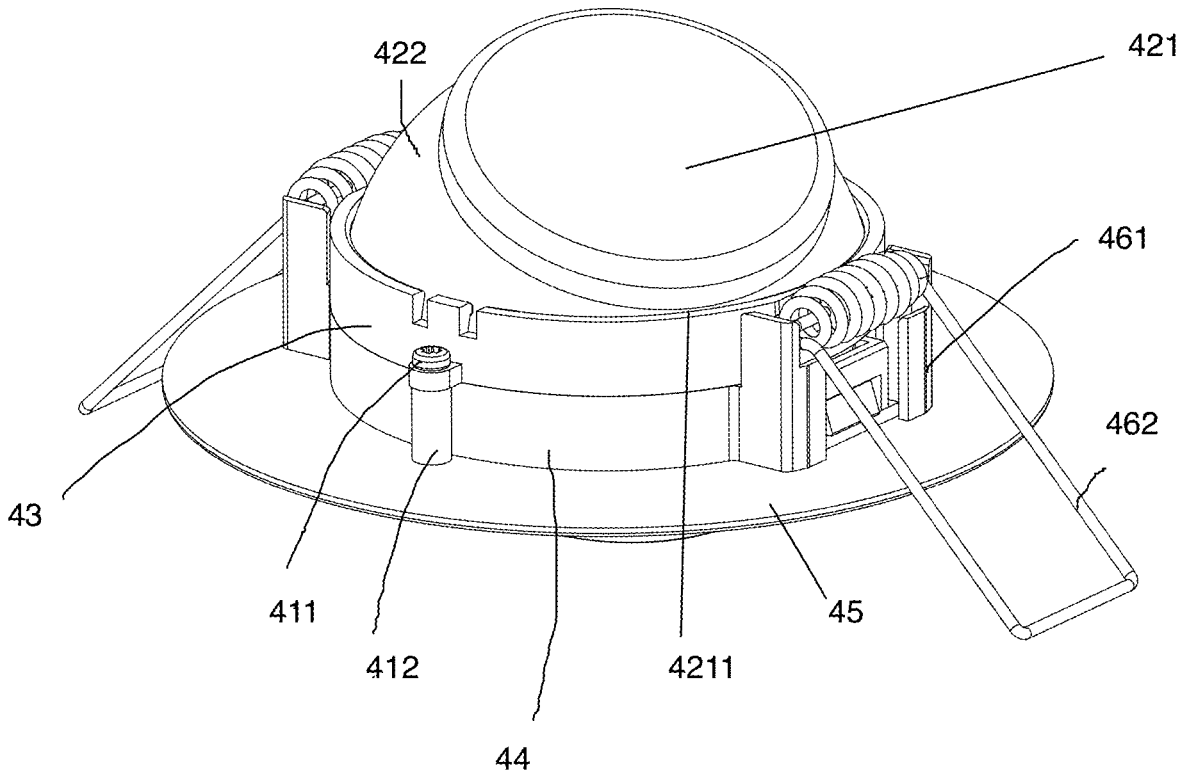
FIG. 4 is a top perspective view of the embodiment of FIG. 1.
Figure 5:
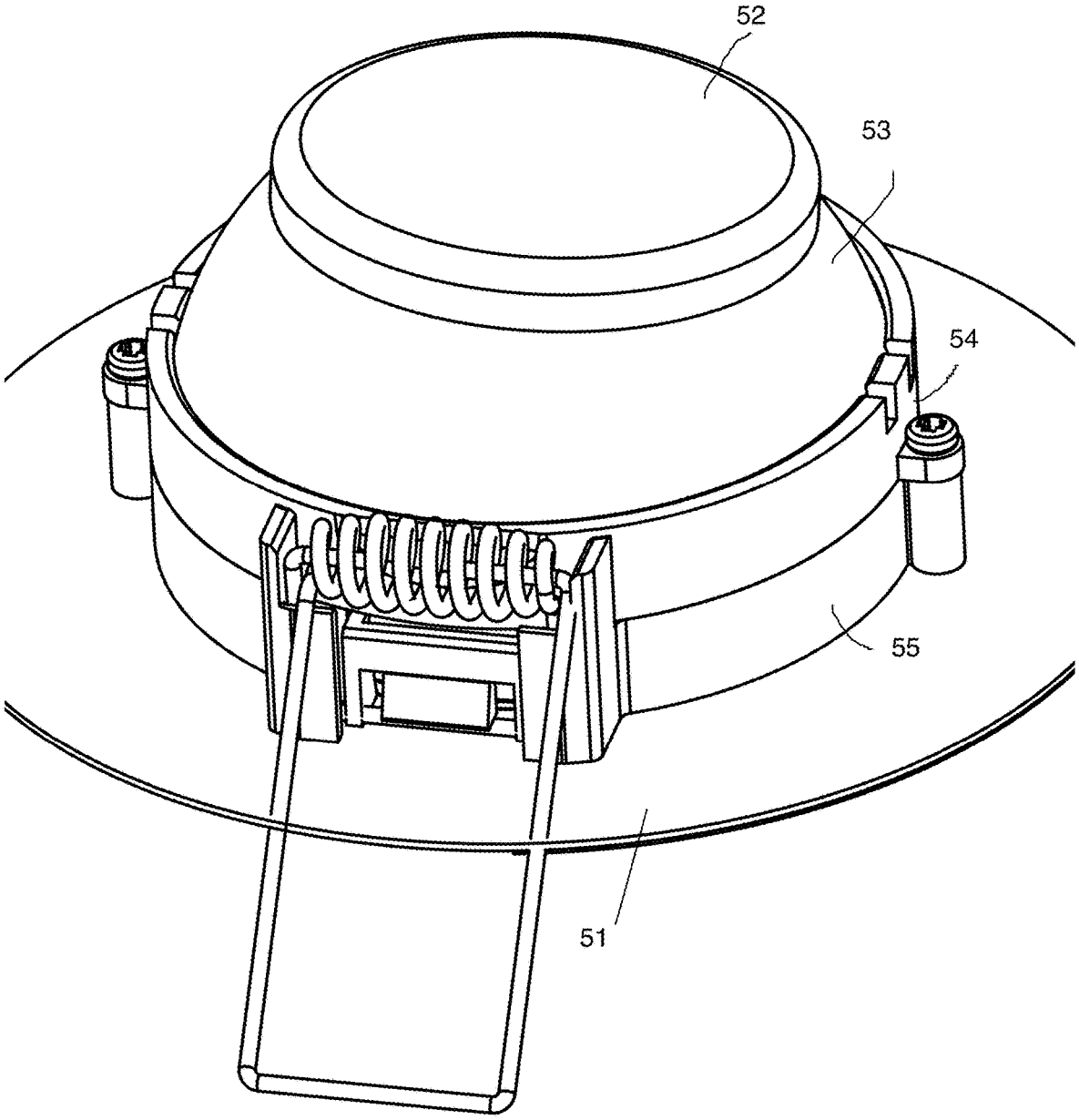
FIG. 5 is an enlarged view of the embodiment for explaining more features.

Please refer to FIG. 1 to FIG. 5, which illustrate a downlight apparatus embodiment. FIG. 1 is an exploded view of a diagram for a downlight apparatus embodiment. FIG. 2 is a perspective view of the embodiment of FIG. 1, showing its exemplary use. FIG. 3 is a sectional perspective view of the inner rotation structure of the embodiment of FIG. 1. FIG. 4 is a top perspective view of the embodiment of FIG. 1. FIG. 5 is an enlarged view of the embodiment for explaining more features.

In FIG. 1, the downlight apparatus includes a rotatable support 12, a confining structure made of a top cover 14 and a bottom cover 13. The rotatable support 12 has a rotatable surface. The rotatable surface includes a partial-sphere external surface 122.

The top cover 14 and the bottom cover 13 together defines a containing and rotation space 182, 183 for holding the rotatable support 12. The rotatable support 12 may be rotated between the top cover 14 and the bottom cover 13. The rotatable support 12 is also held, not able to escape from, the surrounding of the top cover 14 and the bottom cover 13.

There are two screws 141, 142, in this example for fixing the top cover 14 to the bottom cover 13 by inserting the screws 141, 142 into corresponding screw holes 143 on the bottom cover 13.

A light source 121 is fixed to the rotatable support 12, facing downwardly to a main opening 181 of a surface ring 11. The surface ring 11 is fixed to the bottom cover 13, and the two components may be made in the same molding process as a single unit. There are two slots 15 for receiving two fixing units 16. The fixing units 16 may be deformed and recovered so as to keep the downlight apparatus in a cavity of a ceiling.

There are two extenders 141, 142 on the top cover 14 for keeping the rotation support 12 not to move randomly unless a user applies a force for doing the rotation. The extenders will be explained in more details in following drawings.

In FIG. 2, it shows that the downlight apparatus has a surface ring 21 defining a main opening 25 for light of the light source 26 to output. The light source 26 is fixed to a rotation support 22. In this illustrated example, the rotation support 22 is tilt with respect to the surface ring 21, thus outputting a light not perpendicular to the surface ring 21.

In FIG. 3, the top cover 34 is fixed to a bottom cover 36. In this example, the bottom cover 36 is made of the same piece with the surface ring 32. A light source 315 is fixed to the rotation support 31. The rotation support further has a top ring 312 that may contain driver components inside. A lens 314 is disposed under the light source 315 for forming a desired light beam escaped from the main opening 313 of the surface ring 32. The fixing unit 33 is used for fixing the downlight apparatus in a cavity or an installation box of a ceiling.

A screw 322 is used for inserting into a screw hold 321 for fixing the top cover 34 to the bottom cover 36.

In FIG. 4, it shows that the fixing unit 462, inserted into a slot 461 that is fixed to the bottom cover 44 and the surface ring 45. The fixing unit 462 is provided with an elastic component so that it may deform to enter a narrow opening and then recovered to fix the downlight apparatus to a cavity. The rotation support 422 has a top ring 421. When the rotation support 422 rotates outside a desired range, the top ring 421 engages the top cover 43 to stop further rotation in that direction. The top cover 43 and the bottom cover 44 are fixed by inserting a screw 411 in a screw slot 412 of the bottom cover 44.

In FIG. 5, the surface ring 51 is fixed to the bottom cover 55. The extender 54 that is part of the top cover presses on surface of the rotation support 53. When the rotation is too much, the top ring 52 engages the top cover 53 for stopping further rotation in that direction.

In general terms, a downlight apparatus includes a light source, a rotatable support, a confining structure, and a fixing unit.

The light source may include one or more LED module. The LED modules may be mounted on a light source plate with wires and a heat sink. The light source plate may be attached to a surface of the rotatable support. The LED modules are provided with a proper driver current. In some embodiments, the LED modules may have different types, e.g. with different color temperatures or colors, and the LED modules may be controlled to generate different mixed light effect.

The rotatable support has a rotatable surface. The rotatable surface has a partial-sphere external surface. The partial-sphere external surface refers to a surface substantially similar to a portion or all of a three-dimension surface of a sphere. Please be noted that the partial-sphere external surface does not need to be a perfect sphere surface, once the surface provides a rotatable joint effect in three-dimension space.

The light source is fixed to the rotatable support. Therefore, when the rotatable support is rotated, a light emitting direction of the light source is changed correspondingly. Specifically, the light surface is fixed to the rotatable support, and the rotatable support is rotated with respect to the confining structure. If the confining structure is fixed to a ceiling, the light emitting direction of the light source is changed when the rotatable support is rotated with respect to the confining structure.

The confining structure is provided for holding the rotatable support so that the rotatable support may be rotated with respect to the confining structure. The confining structure has an inner surface defining a rotating space. The rotatable support is rotated within the rotating space. The rotating space refers to a three-dimension area where the rotatable support is rotated therein.

The fixing unit is connected to the confining structure for fixing the downlight apparatus in a cavity. For example, the fixing unit may include two elastic arms that may be deformed to fit in the cavity and extended back to keep the downlight apparatus in the cavity. The fixing unit may be directly or indirectly connected to the confining structure. For example, the fixing unit may be directly fixed to a socket of the confining structure or an intermediate component like a surface ring that is connected to the confining structure.

Figure 6A:
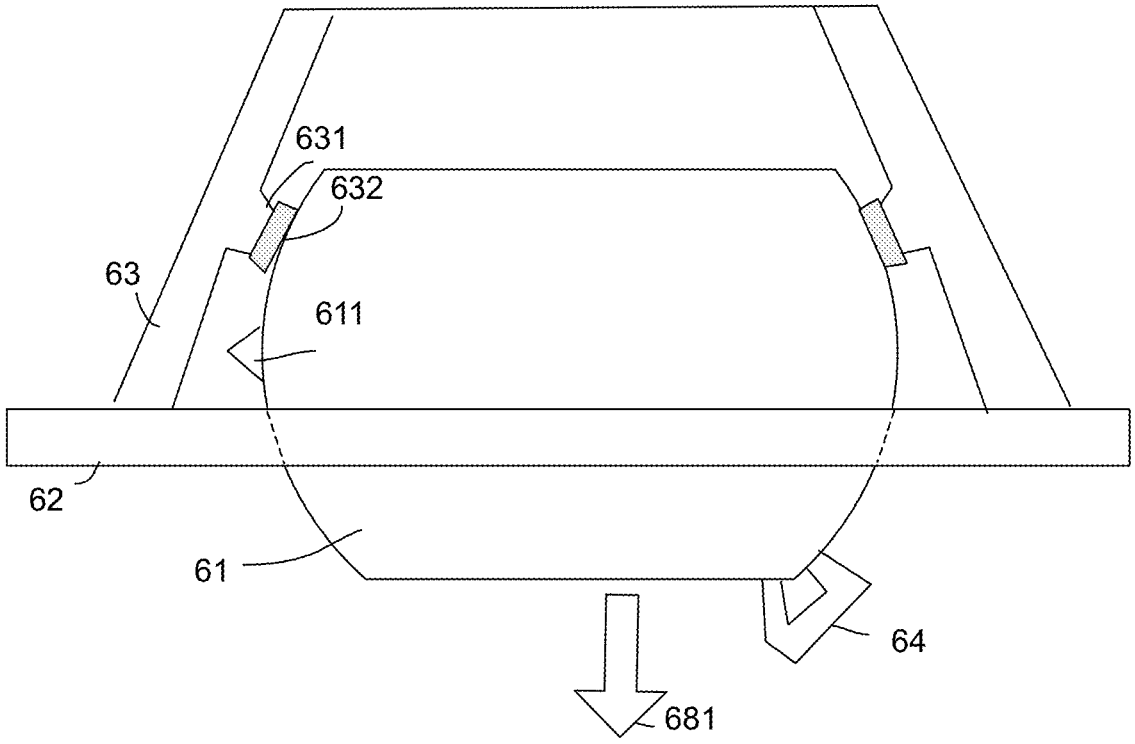
FIG. 6A illustrates a first status of another downlight apparatus embodiment.
Figure 6B:
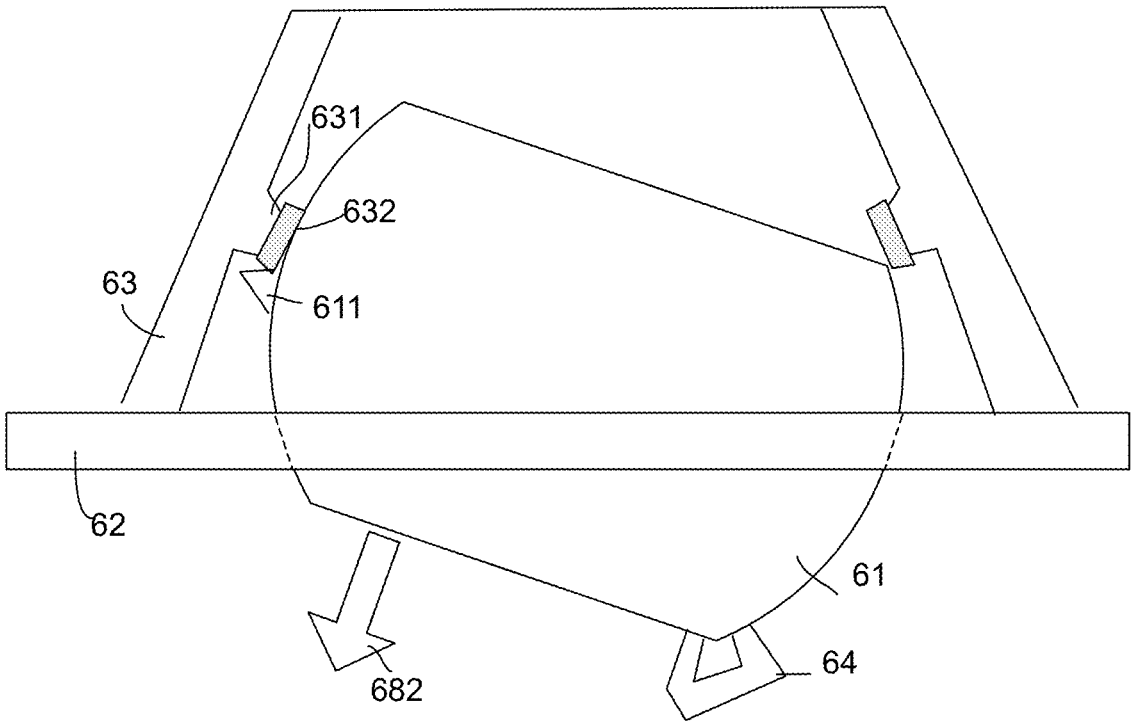
FIG. 6B illustrates another status of the embodiment of FIG. 6A.

For example, FIG. 6A illustrates a first status of another downlight apparatus embodiment. FIG. 6B illustrates another status of the embodiment of FIG. 6A.

FIG. 6A and FIG. 6B show a different structure of such downlight apparatus.

In FIG. 6A, the rotation support 61 is rotated in a containing space by a surface ring 62, which is now the bottom cover, and the top cover 63. The top cover 63 has an extender 631, with its head disposed with a rubber unit for increasing friction between the extender 631 and the rotation support 61 to prevent undesired random move while users do not apply force thereon.

In addition, a limiting device 611 is provided to limit the rotation range of the rotation support 61. A handle is disposed on the rotation support 61 so that it would be easier for users to adjust rotation angles 681, 682.

In some embodiments, the confining structure has a top cover and a bottom cover. When the top cover and the bottom cover are assembled together, the top cover and the bottom cover together form a containing space in which the partial-sphere surface of the rotatable support may be rotated therein. In addition, the containing space keeps the rotatable support staying in the containing space, instead of leaving unless the top cover is detached from the bottom cover.

The top cover has a lateral blocking structure. The top cover also has a first top opening and a first bottom opening. A diameter of the first top opening is smaller than a diameter of the partial sphere surface. A diameter of the first bottom opening is larger than the first top opening. As mentioned above, such configuration keeps the rotatable support to stay in the containing space defined by the top cover and the bottom cover.

In some embodiments, the lateral blocking structure is mainly a surrounding wall for holding the rotatable support.

In some other embodiments, the lateral blocking structure may include multiple curve bars for holding the rotatable support. In other words, the "surrounding wall" may have holes or even may be provided with several equivalent curve bars once the curve bars define the containing space to keep the rotatable support within for rotating.

In some embodiments, the top cover may be a ring shape body with a smaller top opening than its bottom opening. The ring shape body may also has a corresponding inner surface for the partial-sphere surface of the rotatable support.

In some embodiments, the top cover may have one or more elastic extenders for pressing a surface of the rotatable support. The elastic extenders apply a force on a surface of the rotatable support so that the rotatable support would not make undesired movement when users do not give force thereon.

To increase the effect, a friction enhancer may be mounted on the elastic extender for increasing friction between the confining structure and the rotation support so that the rotatable support is not moved without an external force For example, the friction enhance may be a rubber component, or may be a comb structure at end of the elastic extender. The elastic extender may be a separate component from the confining structure or may be a portion that is bent and leaning toward the rotatable support from a main body of the confining structure.

In some embodiments, there may be multiple segment structures for securing the rotation support staying in corresponding rotation angles with a force. For example, protruding grooves or concave groove with corresponding elastic may form such segment structures so that when the rotation support rotates to a specific angle, two corresponding components respectively on the rotation support and the confining structure meet together and creates a certain resistance for preventing the rotation support to continue rotating unless a force is larger than a predetermined threshold.

Such design makes the downlight apparatus more stable, though losing certain freedom of rotation. But, under some design needs, such configuration provides better satisfaction.

In some embodiments, the bottom cover is fixed to a surface ring. The surface ring is a ring with a main opening for light of the light source to output. The bottom side of such surface ring is positioned downwardly so that users may see the its bottom side when the downlight apparatus is fixed to a cavity of a ceiling. Such surface ring is wider and commonly seen in traditional downlight devices. The back side of the surface ring is facing to the ceiling.

The bottom cover and the surface ring may be made as a single piece, e.g. made from the same molding procedure. Please be noted that the bottom cover and the surface may also be two pieces to be assembled during manufacturing.

In some embodiments, there is a limiting device for restricting a rotation range of the rotatable support. Although partial-sphere external surface may provide all angle rotation in a three-dimension space, when the partial-sphere approaches a complete sphere, it is not necessary to do so. In real applications, considering wire limitation to an external power source, the main opening size of the surface ring the downlight apparatus and other factors, it would be better to keep the rotation within a certain range.

Such limiting device have various ways to implement. For example, in some embodiment, the limiting device may be a top ring above the rotation support. When the rotation support rotates over the rotation range, the top ring engages the confining structure for stopping the rotatable support for further rotation.

In such design, the top ring may have a containing space, which is a nice place for containing driver components of a driver for converting an external power source, like a 110V or 220V electricity to a driving current for the light source.

In some embodiments, there may be a lens for converting a light of the light source to a light beam. Such lens may be a single convex or concave lens, and may be made of a lot of micro-lens structures together forming a desired light beam.

Since such downlight apparatus is designed for meeting users' needs for adjusting light output. It would be even better if the lens may be adjusted by changing its distance to the light source, which may provide different focal length and different light beam characteristics for different needs, e.g. to focus on a near object or a far object.

A screwed sleeve may be used for changing a relative distance between the lens and the light source. Furthermore, multi-lens structure may be used for getting more output combinations.

Figure 8A:
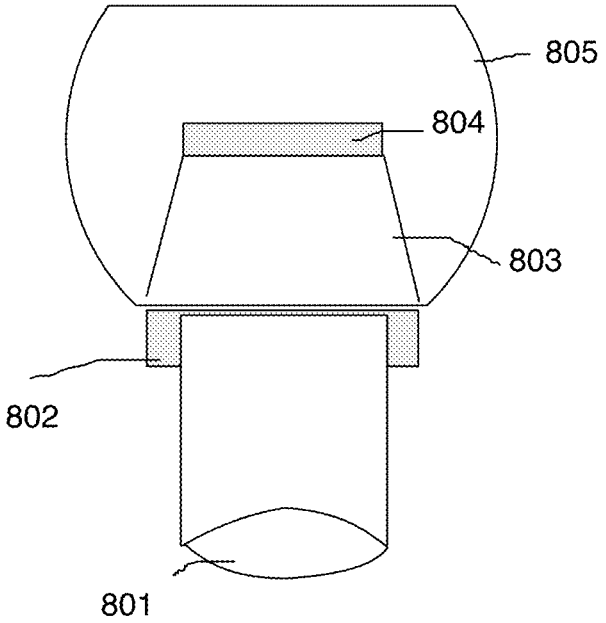
FIG. 8A illustrates a first status of a downlight apparatus with a lens.
Figure 8B:
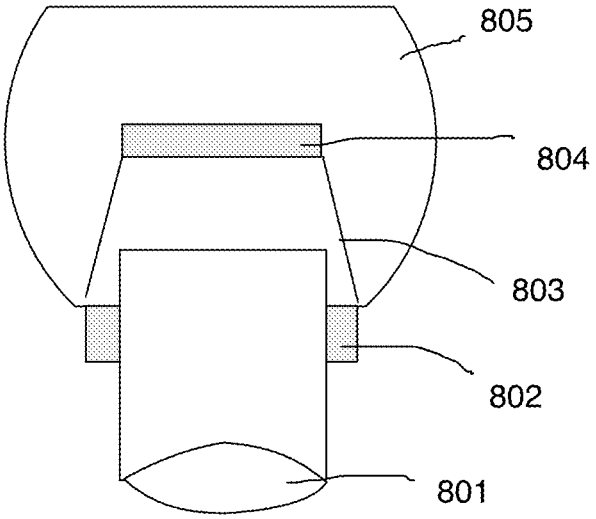
FIG. 8B illustrates another status of the lens with a different distance from the light source.

For example, FIG. 8A and FIG. 8B show an example of such design.

In FIG. 8A and FIG. 8B, the rotation support 805 is fixed with a light source 804. There is a cup shaped reflector 803 for reflecting light and a lens 801 for generating a light beam. There is an adjustment device like a screw sleeve. Users may adjust the distance between the lens 801 and the light source 804 to get different light beam characteristic.

In some embodiments, the top cover and the bottom cover are fixed with a reverse hook structure for increasing difficulty on detaching the top cover from the bottom cover. In such design, when manufacturers assemble the top cover to the bottom cover, the reverse hook structure ensures unless using certain tools, users may not easily detach the top cover from the bottom cover, causing undesired accident.

Other methods, like using screws or glues, may also be used for fixing the top cover to the bottom cover. In some designs, users may even want to replace the rotatable support for a different light source. In such case, it would be more convenient for designing a detachable structure like clips for easy assembly work.

In some embodiments, the bottom cover has a handle for users to hold the handle for rotating the rotatable support. This is particularly helpful when such downlight apparatus is designed for being rotated to change its output light angle.

In some embodiments, the confining structure may include a heat sink for dissipating heat of the light source, e.g. a fin, a heat conductive material housing.

In some embodiments, there may be further a controller for detecting a current rotation status to determine a corresponding light characteristic for the light source to emit light. For example, when the light output direction is set downwardly, the controller may a light strength, a color temperature, a color or other characteristic that is different when the light output direction is set with a tilt angle. Usually, people may have different needs for different light characteristics when they want to rotate the rotation support for getting a different light output angle.

In some embodiments, the confining structure may include an elastic deformable structure to enlarge an entrance size for receiving the rotatable support and holding the rotatable support by an elastic force of the deformable structure.

In other words, such elastic structure ensures the rotatable support to enter the containing and rotation space of the confining structure. The elastic force of the elastic structure ensures the rotatable support not easy to escape from the rotation space.

Figure 7A:
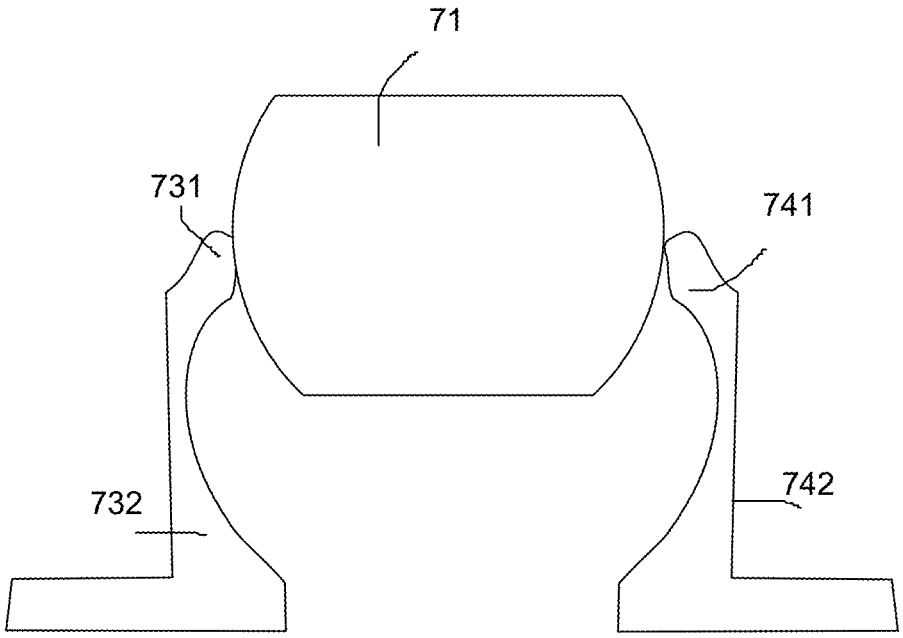
FIG. 7A illustrates a rotatable support is moving into a confining structure in anther embodiment.
Figure 7B:
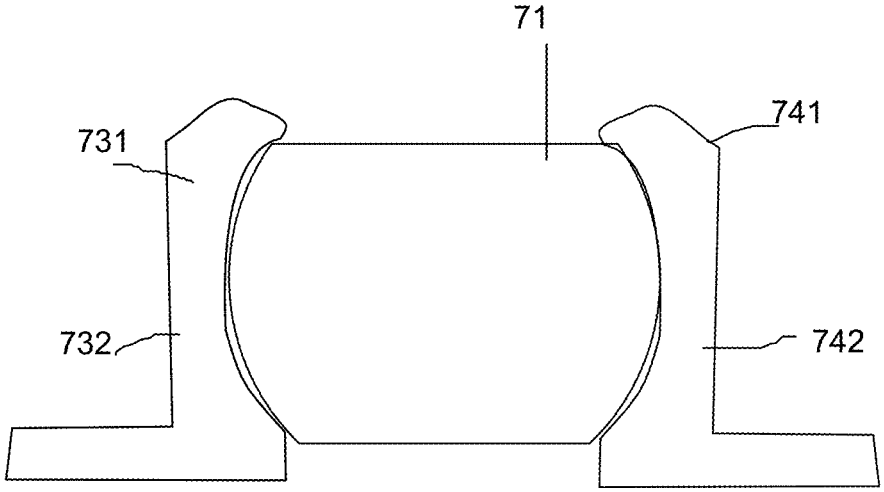
FIG. 7B illustrates the rotatable support of FIG. 7A being inserted into the confining structure.

For example, FIG. 7A and FIG. 7B show a different embodiment.

In FIG. 7A and FIG. 7B, the rotation support 71 is entered into a rotation space of the top cover 731 and the bottom cover 732. In this example, the top cover 731 has some elastic structures like elastic bars, which may be deformed when the rotation support 71 is squeezed into the containing space. After the rotation support 71 enters the containing space, the rotation support 71 may be rotated and held in the containing space.

In some embodiments, there may be a motor for driving the rotatable support to rotate. For example, a wireless control circuit is disposed in the downlight apparatus. Users may use their mobile phone to adjust the rotation angle by trigger the motor to perform the rotation of the rotation support. In some cases, a controller without wireless connection may also be programmed to change the rotation of the rotation support, e.g. the downlight apparatus providing different light output angles in the morning and in the afternoon.

Figure 9:
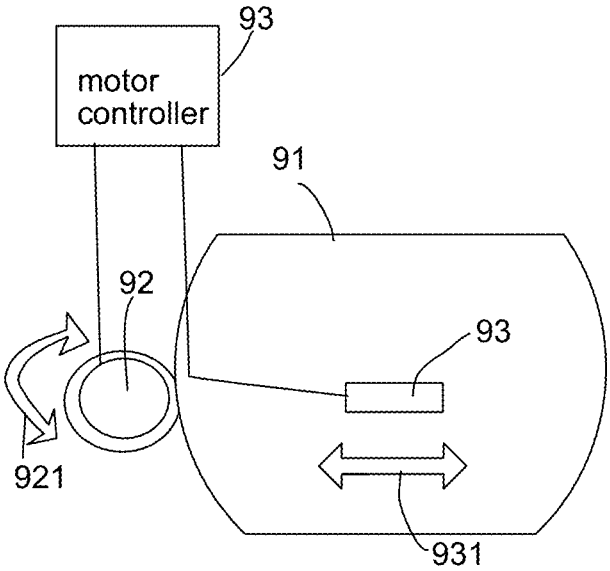
FIG. 9 illustrates a motor controlled rotation embodiment.

For example, FIG. 9 shows one such example.

In FIG. 9, a motor controller 93 received control commands from a program storage or a wireless channel, e.g. from a mobile phone with necessary driver and circuits. The motor controller 93 drives two motors 92, 93 for rotating the rotation support 91 in two directions 921, 931. With the two rotation directions combined 921, 931, the rotation support 91 may be rotated in any allowable rotation angle.

People who have windows may find such feature particularly helpful because the sunshine changes its direction along the day time. In the night, the downlight apparatus may change its output light characteristic, as mentioned above.

In addition to the above-described embodiments, various modifications may be made, and as long as it is within the spirit of the same invention, the various designs that can be made by those skilled in the art are belong to the scope of the present invent

The invention claimed is:

1. A downlight apparatus, comprising:

a light source comprising a LED module;

a rotatable support having a rotatable surface, the rotatable surface having a partial-sphere external surface, the light source being fixed to the rotatable support, when the rotatable support being rotated, a light emitting direction of the light source being changed correspondingly;

a confining structure for holding the rotatable support to rotate, the confining structure having an inner surface defining a rotating space, the rotatable support being rotated within the rotating space; and a fixing unit connected to the confining structure for fixing the downlight apparatus in a cavity, wherein the confining structure comprises a top cover and a bottom cover, wherein the bottom cover has a handle for users to hold the handle for rotating the rotatable support.

2. The downlight apparatus of claim 1, the top cover has a lateral blocking structure, a first top opening and a first bottom opening, a diameter of the first top opening is smaller than a diameter of the partial sphere surface, a diameter of the first bottom opening is larger than the first top opening.

3. The downlight apparatus of claim 2, wherein the lateral blocking structure has a surrounding wall for holding the rotatable support.

4. The downlight apparatus of claim 2, wherein the lateral blocking structure comprises multiple curve bars for holding the rotatable support.

5. The downlight apparatus of claim 2, wherein the top cover is a ring shape body.

6. The downlight apparatus of claim 5, wherein the top cover has an elastic extender for pressing a surface of the rotatable support.

7. The downlight apparatus of claim 6, wherein the elastic extender is mounted with a friction enhancer for increasing friction between the confining structure and the rotation support so that the rotatable support is not moved without an external force.

8. The downlight apparatus of claim 6, further comprising multiple segment structures for securing the rotation support staying in corresponding rotation angles with a force.

9. The downlight apparatus of claim 2, wherein the bottom cover is fixed to a surface ring, the surface ring has a main opening for light of the light source to output.

10. The downlight apparatus of claim 1, further comprising a limiting device for restricting a rotation range of the rotatable support.

11. The downlight apparatus of claim 1, wherein a limiting device is a top ring above the rotation support, when the rotation support rotates over the rotation range, the top ring engages the confining structure for stopping the rotatable support for further rotation.

12. The downlight apparatus of claim 11, wherein the top ring contains a driver for providing a driving current to the light source.

13. The downlight apparatus of claim 1, further comprising a lens for converting a light of the light source to a light beam.

14. The downlight apparatus of claim 1, further comprising a lens adjusting device for users to adjust a distance between the lens and the light source for changing an output light effect.

15. The downlight apparatus of claim 1, wherein the top cover and the bottom cover are fixed with a reverse hook structure for increasing difficulty on detaching the top cover from the bottom cover.

16. The downlight apparatus of claim 1, wherein the confining structure comprises a heat sink for dissipating heat of the light source.

17. The downlight apparatus of claim 1, further comprising a controller for detecting a current rotation status to determine a corresponding light characteristic for the light source to emit light.

18. The downlight apparatus of claim 1, wherein the confining structure comprises an elastic deformable structure to enlarge an entrance size for receiving the rotatable support and holding the rotatable support by an elastic force of the deformable structure.

19. The downlight apparatus of claim 1, further comprising a motor for driving the rotatable support to rotate.

* * * * *